United States Patent [19]

Schmidt

[11] 4,372,275

[45] Feb. 8, 1983

[54] FUEL VAPORIZING CARBURETOR

[76] Inventor: Arlo R. Schmidt, 703 DeClark St., Beaver Dam, Wis. 53916

[21] Appl. No.: 149,935

[22] Filed: May 14, 1980

[51] Int. Cl.[3] ..... F02M 17/28

[52] U.S. Cl. ..... 123/522; 123/545; 123/585; 261/96

[58] Field of Search ..... 123/522, 523, 545, 587, 123/585; 261/96, 102, 105, 97

[56] References Cited

U.S. PATENT DOCUMENTS

| | | | |
|---|---|---|---|
| 1,058,407 | 4/1913 | Candlish | 123/522 |
| 3,032,023 | 5/1962 | Kruger | 123/545 |
| 3,336,734 | 8/1967 | Schultz | 261/96 |
| 3,653,643 | 4/1972 | Tucker | 261/96 |
| 3,874,353 | 4/1975 | Wooldridge | 123/522 |
| 3,892,547 | 7/1975 | Tucker | 261/96 |
| 4,268,802 | 5/1981 | Garretson | 123/523 |

*Primary Examiner*—Charles J. Myhre
*Assistant Examiner*—Andrew M. Dolinar
*Attorney, Agent, or Firm*—Ronald E. Barry

[57] ABSTRACT

A liquid fuel vaporizing carburetor for an internal combustion engine including a housing having a fuel reservoir, a filter assembly including a plurality of filters of progressively smaller pores positioned in said housing; one of said filters being immersed in the fuel reservoir, a baffle for drifting incoming air into the filter in the reservoir and secondary air into openings in the housing to add secondary air to the air-fuel mixture as the air-fuel mixture passes through the filter assemblies.

8 Claims, 7 Drawing Figures

FUEL VAPORIZING CARBURETOR

BACKGROUND OF THE INVENTION

Conventional internal combustion engines employ a carburetor for mixing air with the fuel and a manifold for distributing the mixture to the engine. The carburetor includes a venturi with fuel inlet openings provided downstream from the venturi. The venturi creates a partial vacuum to draw raw fuel through the fuel inlet openings into the airstream where it is mixed with the airstream as it passes through the manifold to the engine. Since the fuel enters the airstream as a mist or small fuel droplet, complete mixture does not occur thus resulting in incomplete combustion of the fuel in the engine. Maximum air fuel ratios in a conventional carburetor are in the order of 16 to 1. It has also been established that a completely vaporized fuel will produce greater efficiencies of combustion and air fuel ratios can be increased to 22 to 1. At the higher air fuel ratios, greater combustion occurs with the vaporized fuel because of the better distribution of the fuel throughout the internal combustion engine cylinders which also results in a lowering of the concentration of hydrocarbon and a carbon monoxide emissions from the engine.

Attempts at lowering emissions from internal combustion engines have been directed to the use of catalytic converters in the exhaust system and exhaust gas recycling systems for completing combustion of the fuel prior to exhausting the gas to the atmosphere. However, these systems do not add to the useful work available from the engine, but increase the load on the engine resulting in a reduced efficiency in miles per gallon achievable by the engine.

Fuel vaporizing carburetor of a type similar to the present invention are disclosed in U.S. Pat. No. 3,653,643, issued Apr. 4, 1972 entitled "Carburetor" and U.S. Pat. No. 3,892,547 issued July 1, 1975 entitled "Vaporizing Carburetor." Both of these carburetors have proven effective in increasing fuel efficiency for short periods of time. Difficulties have been experienced in fuel control and in regulating the fuel-air ratio.

SUMMARY OF THE INVENTION

The liquid fuel vaporizer according to the present invention can be substituted for the conventional carburetor for direct admission of the vaporized fuel into the manifold of the engine. The vaporizer is provided with a series of filters of progressively smaller openings through which air saturated with fuel is drawn by the vacuum in the engine to produce a completely vaporized fuel-air mixture. Secondary air inlets are provided in the vaporizer to introduce air into the path of travel of the vaporized fuel as it passes through the filters. This increases the fuel-air ratio thereby assuring more complete combustion of the vaporized fuel with a corresponding increase in fuel economy and a reduction in objectionable emissions. At the higher air fuel ratios, a loss of power will occur, however, the increase in efficiency particularly with respect to the increased miles per gallon more than compensates for this loss of power.

Additional efficiencies may be achieved by preheating the fuel, air or the fuel-air vapor. This can be done by utilizing electric heaters or by circulating the hot water from the radiator through coils located in the path of travel of the air, fuel or fuel-air vapor.

DRAWINGS

DESCRIPTION OF THE PREFERRED EMBODIMENT

Figure 1:
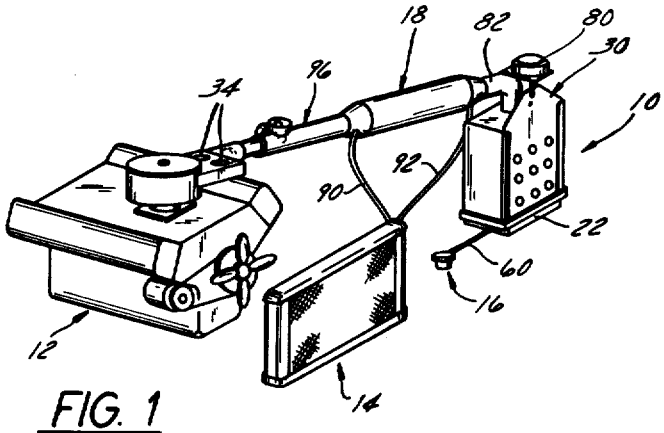
FIG. 1 is a perspective view showing the carburetor according to the invention connected to the manifold of an internal combustion engine.

Referring to FIG. 1, the carburetor 10 according to the present invention is shown connected to a conventional internal combustion engine 12, radiator 14 and fuel pump 16. The carburetor 10 operates in substantially the same manner as a conventional carburetor in that air is drawn through the carburetor 10, mixed with raw fuel delivered by fuel pump 16 into the vaporizer where it is vaporized as it passes through the carburetor 10. An air-fuel heater 18 can be provided on the down stream side of the carburetor 10 to heat the air-fuel vapor on its way to the engine 12. The amount or volume of air drawn through the carburetor 10 can be controlled by the conventional butterfly valve arrangement generally found in a conventional carburetor.

Figure 2:
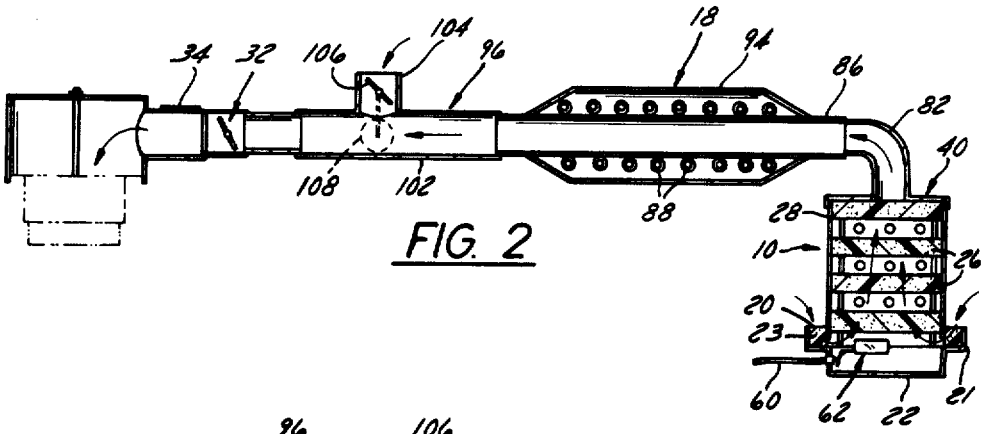
FIG. 2 is a sideview and section showing the carburetor and a fuel-air heater.
Figure 3:
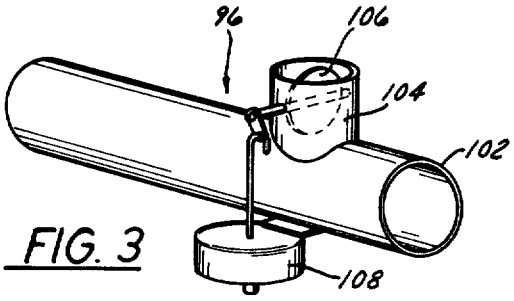
FIG. 3 is a perspective view of the vacuum controlled secondary air inlet.

More specifically and referring to FIG. 2, a cross-sectional view is shown of the air-fuel passages from the carburetor 10 to the engine 12. In this regard, primary air enters the carburetor 10 through an annular air inlet 20 provided around the lower perimeter of the carburetor housing 21. The air passes through an initial open cell filter 23 located in a fuel reservoir 22 provided in housing 21 which is filled with liquid fuel 24. The air, after passing through filter 23 is drawn upward through a plurality of filter assemblies 26 located within a housing 28. The air, as it passes through the fuel in reservoir 22, is separated into small air bubbles by the porous filter 23. The air bubbles then pass through the filter members 26, which are of progressively smaller porosity to reduce the air bubbles down to a very minute size each of which is covered with fuel. The vaporized fuel can then be drawn through heater 18 prior to entering the manifold of the engine 12.

Means are provided for admitting secondary air into the spaces between the filter assemblies 26. Such means is in the form of a secondary air inlet assembly 30 provided on the filter assembly housing 28 as described hereinafter. Additional secondary air can be introduced downstream of the preheater. Back pressure surges from the manifold are prevented from entering the carburetor 10 by means of a butterfly valve assembly 32 and a pair of relief valves 34 provided in the top of the return line.

Figure 4:
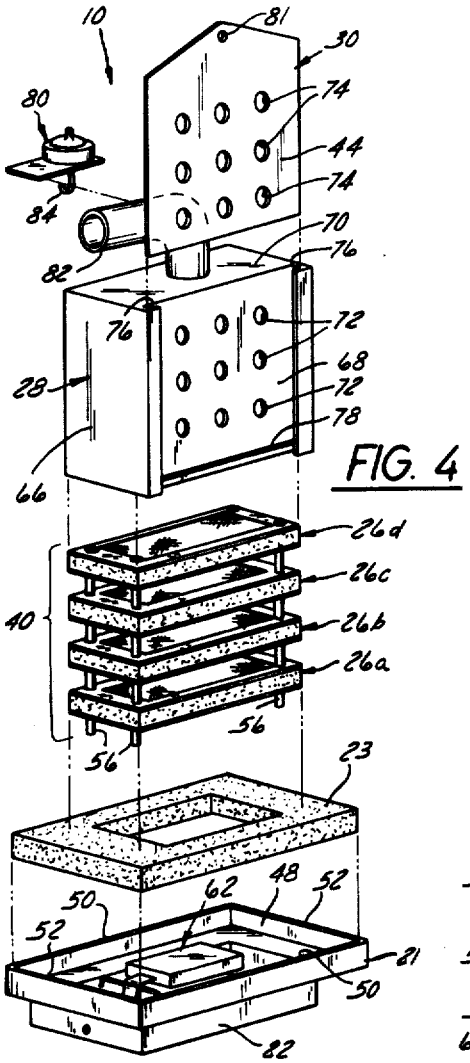
FIG. 4 is an exploded perspective view of the carburetor according to the invention.
Figure 7:
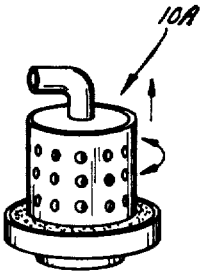
FIG. 7 is an alternate form of vaporizer 10A in the housing and having an annular housing and a sleeve-type secondary air control.
Figure 6:
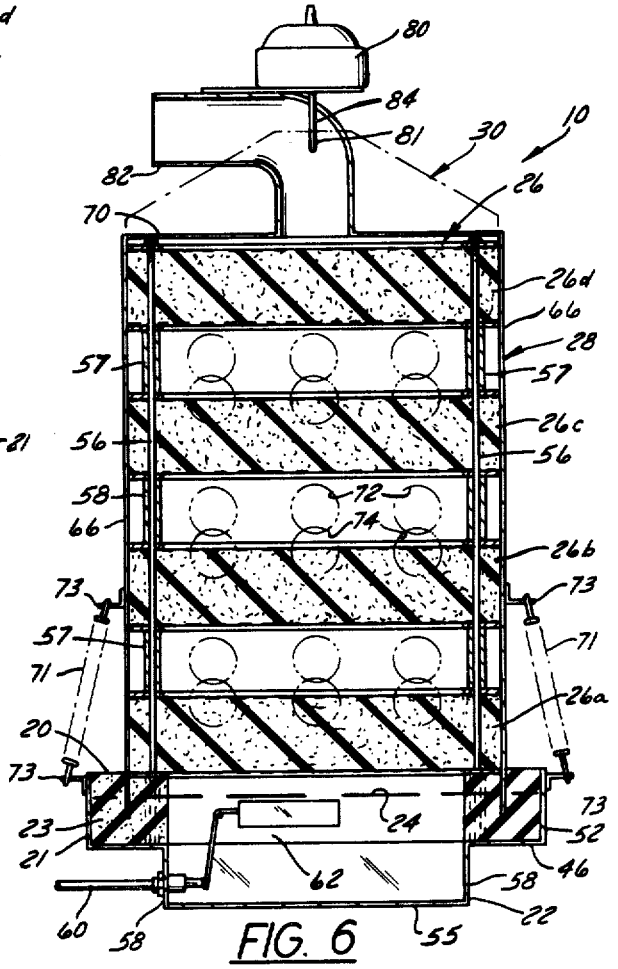
FIG. 6 is an elevation view in section showing filter assemblies in the secondary air inlet control assembly.

Referring to FIG. 4, the carburetor 10 is more clearly shown and generally includes a fuel reservoir housing 21, filter assembly housing 28, a fuel reservoir filter 23, a vaporizing filter assembly 40, and a secondary air control assembly 30. Although the general configuration of the carburetor is shown in the form of a rectangle, it can be constructed in an annual form as shown in FIG. 7 or square depending on the space available within the confines of the engine compartment of an automobile.

The fuel reservoir housing 21 includes a bottom plate 46 having a central opening 48 which in enclosed by sidewalls 50 and end walls 52. The fuel reservoir 22 is provided below the bottom plate 46 and includes a bottom plate 55 and sidewalls 58 which are connected to the edges of the opening 48 in the bottom plate 46. The fuel pump 16 is connected to the reservoir 22 by means of an inlet tube 60. The fuel level within the reservoir 22 is controlled by means of a float valve assembly 62 as described hereinafter.

Air initially drawn into the fuel reservoir 22 is separated into small bubbles by means of the air inlet filter 23. The inlet filter is formed of an open cell plastic material such as reticulated polyurethane foam i.e., filter foam, having approximately forty pores per inch. The inlet filter 23 is seated on the plate 46 within the fuel reservoir housing 21.

The filter assembly 40 is formed of a plurality of filter members 26 each of which has a filter material 42 such as reticulated polyurethane foam which is progressively of the same or smaller porosity than the preceding filter material 42. As an example, filter member **26*a* has a filter material 42 of forty pores per inch; filter member 26*b* has a filter material 42 having fifty pores per inch; material 42 in member 26*c*, sixty pores per inch; and filter material 42 in filter member 26*d*, eighty pores per inch. This relationship is shown by way of example only since filter members 26*a* and 26*b* could be both of forty pores per inch with the succeeding filter members 26*c* and 26*d*** both being of smaller openings and a corresponding greater number of pores per inch.

Figure 5:
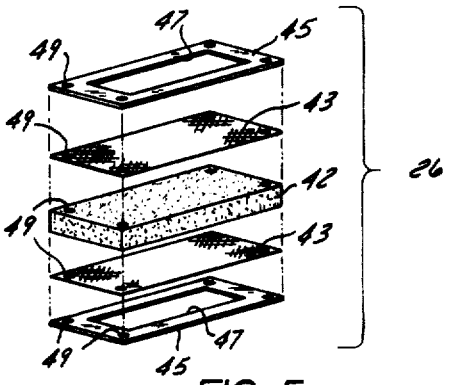
FIG. 5 is an exploded perspective view of one of the filter assemblies.

Referring to FIG. 5, one of the filter members 26 is shon with an open cell filter material 42 supported on each side by a screen 43. A rectangular frame 45 having an open center 47 is provided on the outer surface of the screens 43. An opening 49 is provided in the four corners of each of frames 45, screens 43 and filter material 42 for assembly purposes as described hereinafter.

The filter members 26 are assembled on four posts 56 which extend through the openings 49 and act as legs to support the filter assembly 40 on the housing 21. In this regard, means are provided on each side of each filter member 26 to retain the filter members in a spaced relation on the posts. Such means is in the form of tubular spacers 57 provided on the posts 56 between each of filter members 26.

The filter assembly housing 28 is in the form of a rectangular box having an outer dimension smaller than the walls 50, 52 of the reservoir housing 21. The housing 28 includes end walls 66, side walls 68 and a top wall 70. One of the side walls 68 is provided with a plurality of secondary air openings 72.

The housing 28 is mounted on the filter assembly 40 with the top wall resting on the top of posts 56. Means are provided for retaining the housing 28 in position on the reservoir housing 21. Such means is in the form of retaining springs 71 connected to brackets 73 provided on the housing 28 and reservoir housing 21.

The secondary air inlets 72 are controlled by the secondary air control 30. In this regard, the assembly 30 includes a panel 44 having a plurality of openings 74 which correspond to the openings 72 in the side walls 68 of housing 28. The panel 44 is used to control the air admitted to the filter assembly 40. This is accomplished by mounting the panel 44 in a pair of grooves 76 provided on each side of the side wall 68. A ledge 78 is provided at the lower end of the sidewall 68 to provide a stop at the bottom of the side wall. In the normal or closed position of the panel 44 with respect to the side wall 68, the panel will rest on the stop 78 with the opening 74 out of alignment with the openings 72.

Means are provided for moving the panel 44 to align the holes 74 with the hole 72 and thereby increase the amount of air being admitted to the filter assembly during operation. Such means can be in the form of a vacuum responsive valve 80 provided at the top of the carburetor 10 and being connected to a hole 81 in plate 44 by a hook 84. The vacuum assembly 80 is operatively connected to an outlet pipe 82 provided at the top of the housing 28. The valve 80 is connected to respond to variations in the vacuum in the pipe 82 to raise or lower the panel 44. It being generally understood that as the vacuum increases the amount of secondary air admitted is also increased to maintain a balanced air fuel ratio to the engine.

Secondary air control can also be controlled by means of an air-fuel sensor provided in the manifold or at the exhaust outlet. Such means sends the hydrocarbons present and adjusts the panel 44 to increase or decrease the admission of secondary air.

Means can be provided for increasing the temperature of the fuel air vapor as it leaves the carburetor and enters the manifold. Such means is in the form of the heater assembly 18. As seen in FIG. 1 the heater assembly includes a straight pipe 86 connected to the pipe 82. A water coil 88 is wrapped around the pipe 86 and is operatively connected to the radiator 14 by flow lines 90 and 92. Water flowing through the radiator 14 will be circulated through the coil 88 and as the water temperature increases the temperature within the tube 86 will increase producing a corresponding increase in the temperature of the fuel air vapor. A cylindrical housing 94 can be provided around the coil 88 to prevent exposure of the coils to atmosphere.

Additional air can be provided if it is deemed necessary. Such means is in the form of an additional supplemental air assembly 96 provided on the end of the pipe 86. The supplemental air inlet includes a tube 102 connected to the tube 86 and an air inlet pipe 104 connected to the tube 102. A butterfly control valve 106 is provided in the pipe 104 and is operatively connected to a vacuum responsive valve 108 to open the valve in response to an increase in vacuum pressure. The vaporizer is protected from backfire pressures in the manifold by means of a butterfly valve 32 and check valve 34.

OPERATION

In operation when the engine is started, a vacuum will be created in the manifold of the engine and will draw air through the filter 23 downward around the lower edge of the end walls 66 and side walls 68 of the housing 28. The air will pass through the filter 23 into the fuel 24 and the reservoir 22. The force of the air entering the housing 21 will push the fuel down until the air passes the edge of the end walls and the side walls. The air will then flow upward through the filter members **26*a*, *b*, *c* and *d* to the outlet tube 82. As the air passes through the various filters, it will be broken down into smaller bubbles with each air bubble carrying a smaller amount of fuel in its outer surface. Secondary air will be admitted into the spaces between the filter members 26 by means of the secondary air control assembly 30. The vacuum valve 80 responds to variations in the vacuum within the tube 82 to raise or lower the panel 44 to change the position of the hole 74 with respect to the hole 72. The vaporized fuel air mixture will then pass through the preheater if used through the supplemental air assembly 96** and into the manifold of the engine.

The embodiments of the invention in which an exclusive property or privilege is claimed, are defined as follows:

1. A liquid fuel vaporizer for an internal combustion engine, said vaporizer comprising;

a housing having an air inlet at one end and an outlet at the other end, a liquid fuel reservoir in said housing, a filter assembly in said housing downstream from said reservoir, said filter assembly including a series of filters of progressively smaller size pores located at spaced intervals within said housing, one of said filters being immersed in said fuel reservoir, means for directing air from said air inlet into said fuel reservoir whereby air passing through said fuel reservoir will pick up fuel and carry it into said filter assembly where the fuel droplets are reduced in size prior to entering the fuel outlet, and secondary air inlet means in said housing for admitting secondary air into the spaces between said filters.

2. The vaporizer according to claim 1 including means for controlling the admission of secondary air in response to a predetermined operating condition of the engine.

3. The vaporizer according to claim 1 including means in said reservoir or maintaining a predetermined level of fluid in said reservoir.

4. The vaporizer according to claim 1 including means connected to the outlet of said vaporizer for heating the vaporized fuel prior to entering the engine.

5. A liquid fuel vaporizer for an internal combustion engine having a manifold, said vaporizer comprising a housing having an opening at each end, one of said openings being connected to the manifold of the engine, a filter assembly positioned in said housing between said openings and said assembly including a plurality of open cell filters of progressively smaller pore size located at spaced intervals, a fuel reservoir in said housing, means for admitting fuel into said reservoir upstream from said filter assembly, and baffle means in said housing for directing incoming air into said fuel reservoir, whereby a vacuum in the manifold will draw air through the fuel reservoir and filter assembly, and means for admitting secondary air into the spaces between said filters.

6. The vaporizer according to claim 5, wherein said secondary air admitting means is responsive to a predetermined engine condition.

7. The vaporizer according to claim 5, wherein said housing includes a fuel reservoir and said fuel admitting means comprises a float valve assembly in said reservoir to maintain a predetermined level of fluid in said housing and further including means for directing air from said air inlet through said fuel reservoir.

8. The vaporizer according to claim 7 including a porous filter positioned in said reservoir and being partially emersed in said fluid in said reservoir.

* * * * *